United States Patent [19]

Sakata et al.

[11] Patent Number: 4,857,117

[45] Date of Patent: Aug. 15, 1989

[54] METHOD OF MANUFACTURING A COLD-ROLLED STEEL SHEET HAVING A GOOD DEEP DRAWABILITY

[75] Inventors: Kei Sakata; Koichi Hashiguchi; Shinobu Okano, all of Chiba, Japan

[73] Assignee: Kawasaki Steel Corporation, Kobe, Japan

[21] Appl. No.: 161,438

[22] Filed: Feb. 25, 1988

Related U.S. Application Data

[63] Continuation of Ser. No. 866,220, May 22, 1986, abandoned.

[30] Foreign Application Priority Data

May 31, 1985 [JP] Japan ..... 60-116661

[51] Int. Cl.[4] ..... C21D 8/04

[52] U.S. Cl. ..... 148/12 C; 148/12 F

[58] Field of Search ..... 148/12 C, 12 F, 12.1

[56] References Cited

U.S. PATENT DOCUMENTS 4,504,326 3/1985 Tokunaga ..... 148/12 C

*Primary Examiner*—Deborah Yee

*Attorney, Agent, or Firm*—Balogh, Osann, Kramer, Dvorak, Genova & Traub

[57] ABSTRACT

A method of manufacturing a cold-rolled steel sheet having a good deep drawability is disclosed, wherein a hot rolled steel sheet having a composition of C≦0.0035%, Si≦1.0%, Mn≦1.0%, Al:0.005-0.10%, P≦0.15%, N≦0.0035%, S≦0.015%, Ti: (48/14N(%)+48/32S(%)) or {4×(C(%)+N(%))}~(3.48/12C(%)+48/14N(%)+48/32S(%)) and Nb: (0.2·93/12C(%))~(93/12C(%))% is cooled within 2 seconds after the completion of finisher rolling and then at an average cooling rate of not less than 10° C./sec until it arrives at a coiling step, and then the cooled steel sheet is coiled at a temperature of not more than 710° C., subjected to a cold rolling at a reduction of not less than 50%, which was subjected to a continuous annealing in a heatcycle inclusive of heating from 400° C. to 600° C. at a heating rate of not less than 5° C./sec and soaking at a temperature range of 700° C.-$Ac_3$ point for 1 second or more.

2 Claims, 2 Drawing Sheets

METHOD OF MANUFACTURING A COLD-ROLLED STEEL SHEET HAVING A GOOD DEEP DRAWABILITY

This application is a continuation of application Ser. No. 866,220, filed May 22, 1986 now abandoned.

BACKGROUND OF THE INVENTION

1. Field of the Invention

This invention relates to a method of manufacturing a cold-rolled steel sheet suitable for use in parts such as automotive body and so on requiring a press formability particularly a deep drawability. More particularly, it relates to a proper method of manufacturing cold-rolled steel sheet having a high ductility, a small anisotropy in material, and excellent deep drawability, aging resistance and resistance to secondary brittleness under an advantageous application of continuous annealing process.

2. Related Art Statement

In general, press-formable steel sheets have hitherto been manufactured by a box annealing process using a low carbon (C: 0.02–0.07% by weight; abbreviated as "%" hereinafter) Al-killed steel as a starting material, but recently been manufactured by a continuous annealing process using an extremely low carbon steel with C<0.01% as a starting material in order to obtain more improved press formability and high productivity.

In these extremely low carbon steels, carbonitride-forming elements such as Ti, Nb, V, Zr, Ta and the like are added in order to fix C and N soluted in steel, which deteriorate ductility, drawability and aging resistance of the steel sheet. Heretofore, these elements have frequently been added alone since they are expensive. A comparison between properties of Ti and Nb which are most popularly used is as follows.

Ti-containing steel has such advantages that the recrystallization temperature is low, and the mechanical properties such as total elongation (El), Lankford value $\bar{r}$-value) and so on are good even when the steel is subjected to a low temperature coiling at not more than 600° C., as compared with Nb-containing steel.

On the other hand, the Nb-containing steel has such advantages that the anisotropy for $\bar{r}$-value is small, and the phosphate treating property as a pretreatment for painting is good, as compared with the Ti-containing steel.

In Japanese Patent Application Publication No. 58-107,414 it is disclosed to simultaneously develop advantages of both Ti and Nb. In this case, the upper limit of Ti amount is restricted to (48/12C(%)+48/14N(%)), which is intended to secure a non-aging property and a deep drawability by preferentially consuming a greater part of Ti as TiN and fixing the solute C with the remaining effective Ti (=total Ti−Ti as TiN) and Nb. As seen from a recent press forming for outer parts of automotive vehicles, a stretch forming is mainly carried out rather than a drawing, and particularly steel sheets having a high ductility are more demanded. In this technique, however, El value is within a level of 46.8–48.1% (corresponding to that of mild steel sheet), which is not yet achieved to the satisfactory level.

It has been found that when an experiment is practically conducted within the effective Ti range in accordance with the above technique, C in steel is not effectively bonded to Ti, resulting in the considerable deterioration of ductility and drawability as well as the degradation of aging property through the remaining solute C.

SUMMARY OF THE INVENTION

It is an object of the invention to provide a method of manufacturing a cold-rolled steel sheet having a better deep drawability by sufficiently developing Ti, Nb composite addition effect.

Under the aforementioned situation, the inventors have been made various investigations on a method of manufacturing a cold-rolled steel sheet having good press formabilities, particularly a good deep drawability, a high ductility, a small anisotropy in material, and improved aging resistance and resistance to secondary brittleness without damaging the above mentioned advantageous points in extremely low carbon, Ti, Nb composite-added steel.

The inventors have examined the Ti, Nb-composite addition effect in detail, and as a result it has been found that in a slab reheating step or a hot roughing rolling step, TiS and TiN are preferentially precipitated and the solute C is fixed with the remaining effective Ti and Nb during lower temperature region such as hot finishing rolling step and after coiling. That is, it has been found that the amount of Ti represented by an equation of (total Ti−Ti as TiN−Ti as TiS) should be used as effective Ti.

Thus, steel sheets sufficiently satisfied as a press-formable steel sheet are first obtained by limiting the amount of each of C, N, S, Ti and Nb in extremely low carbon steel and strictly restricting cooling conditions in the hot rolling and heating and cooling conditions in the continuous annealing.

According to a first aspect of the invention, there is the provision of a method of manufacturing a cold rolled steel sheet having a good formability, which comprises beginning a cooling within 2 seconds after the completion of finisher rolling of a hot rolled sheet of a steel having a composition of not more than 0.0035% of C, not more than 1.0% of Si, not more than 1.0% of Mn, 0.005–0.10% of Al, not more than 0.15% of P, not more than 0.0035% of N, not more than 0.015% of S, (48/14N(%)+48/32S(%))~(3·48/12C(%)+48/14N(%)+48/32S(%)) of Ti and (0.2·93/12C(%))~(93/12C(%)) of Nb;

cooling the final rolled steel sheet at an average cooling rate of not less than 10° C./sec until it arrives at a coiling step;

coiling the cooled steel sheet at a temperature of not more than 710° C.;

subjecting the coiled steel sheet to a cold rolling at a reduction of not less than 50%; and subjecting the cold rolled steel sheet to a continuous annealing in a heatcycle inclusive of heating from 400° C. to 600° C. at a heating rate of not less than 5° C./sec and soaking at a temperature range of 700° C.-$Ac_3$ point for not less than one second.

According to a second aspect of the invention, there is the provision of a method of manufacturing a cold rolled steel sheet having a good formability, which comprises beginning a cooling within 2 seconds after the completion of finisher rolling of a hot rolled sheet of a steel having a composition of not more than 0.0035% of C, not more than 1.0% of Si, not more than 1.0% of Mn, 0.005–0.10% of Al, not more than 0.15% of P, not more than 0.0035% of N, not more than 0.015% of S, 4·(C(%)+N(%))~(3·48/12C(%)+48/14N(%)+48/3-

2S(%)) of Ti and (0.2·93/12C(%))~(93/12C(%)) of Nb;

cooling the final rolled steel sheet at an average cooling rate of not less than 10° C./sec until it arrives at a coiling step;

coiling the cooled steel sheet at a temperature of not more than 710° C.;

subjecting the coiled steel sheet to a cold rolling at a reduction of not less than 50%; and subjecting the cold rolled steel sheet to a continuous annealing in a heatcycle inclusive of heating from 400° C. to 600° C. at a heating rate of not less than 5° C./sec and soaking at a temperature range of 700° C.-$Ac_3$ point for not less than one second.

BRIEF DESCRIPTION OF THE DRAWINGS

The invention will be described with reference to the accompanying drawings, wherein.

DETAILED DESCRIPTION OF THE INVENTION

According to the invention, it is important to elucidate the effectiveness of Ti and Nb by limiting the composition of the starting material as apparent from the above. The details of this elucidation will be described in order below.

First, the invention will be explained with respect to laboratory experimental results.

Each of 18 steels having a chemical composition of trace~0.02% of Si, 0.10;14 0.12% of Mn, 0.007–0.010% of P, 0.02–0.04% of Al, 0.0027% of N, 0.0020% of C, 0.006%, 0.013% or 0.018% of S, 0.015%, 0.025% or 0.034% of Ti, and 0.008% or 0.020% of Nb was produced by melting in a laboratory, which was bloomed into a sheet bar having a thickness of 30 mm, hot rolled to a thickness of 2.8 mm at seven passes and then finally rolled at a temperature of 900±5° C.

The resulting steel sheet was cooled to a temperature of 550° C. at a rate of 35° C./sec by means of a water spray 0.8 second after the completion of final rolling.

Then, the cooled steel sheet was immediately charged into a furnace at 550° C., held at this temperature for 5 hours and subjected to a furnace cooling. A coiling temperature of 550° C. was simulated by this furnace cooling.

Thereafter, the cooled steel sheet was subjected to a cold-rolling at a reduction of 75% after the pickling. Subsequently, the cold rolled steel sheet was subjected to a continuous annealing, wherein it was heated to 700° C. at a heating rate of 12° C./sec by means of a resistance heater and further heated to 780° C. at a heating rate of 3° C./sec and held at 780° C. for 25 seconds and cooled to room temperature at a cooling rate of 5° C./sec.

Then, the resulting steel sheet was subjected to a skin-pass rolling of 0.7% and thereafter submitted to a tensile test.

As test items, use was made of $\bar{r}$-value (Lankford value) as a measure of deep drawability and AI value (aging index) as a measure of aging resistance.

Figure 1:
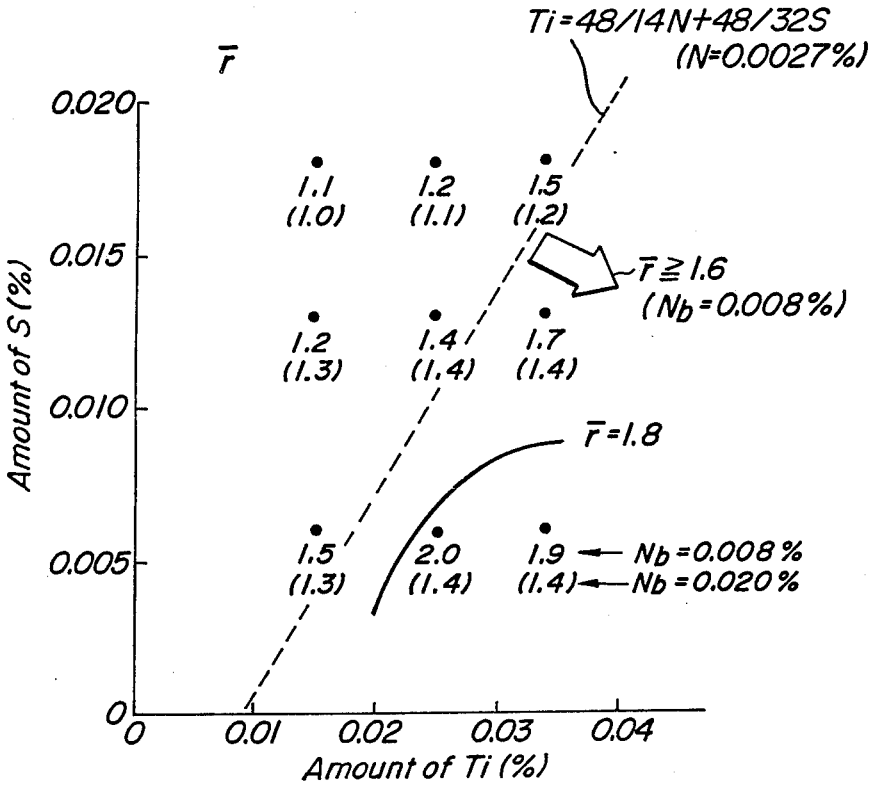
FIG. 1 is a graph showing influences of addition amounts of Ti, S and Nb on $\bar{r}$-value of the steel sheet.
Figure 2:
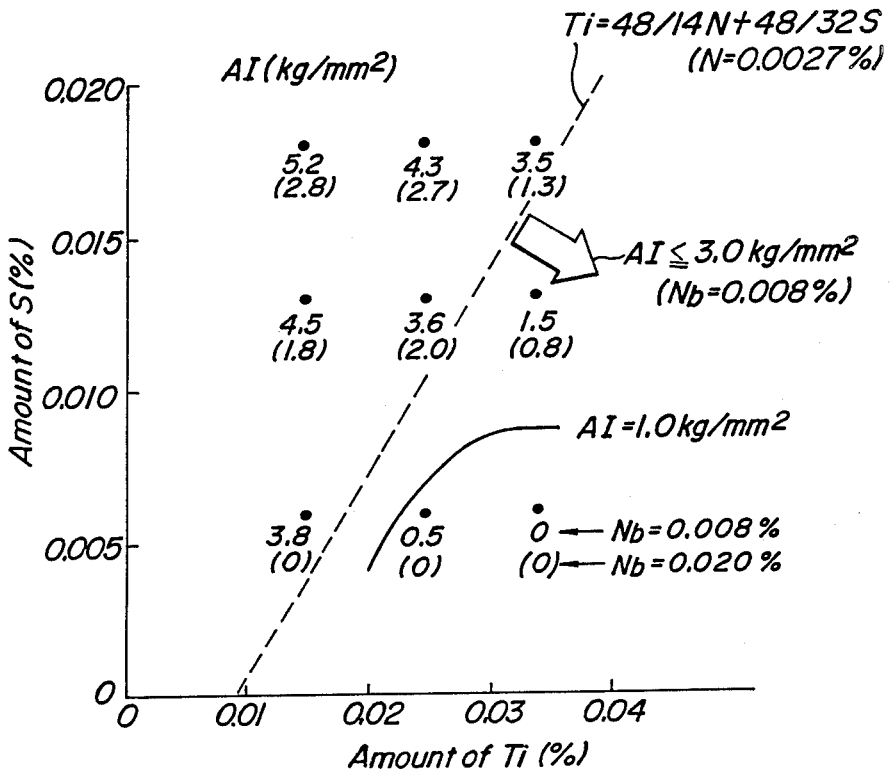
FIG. 2 is a graph showing influences of addition amounts of Ti, S and Nb on AI-value of the steel sheet.

As seen from results in FIGS. 1 and 2, the properties in each of the experimental steels largely vary in accordance with the amounts of Ti, S and Nb.

It is found that when $\bar{r} \geqq 1.6$ and $AI \leqq 3.0$ are made standard as properties required for the pressformable steel sheet, both the above inequalities are satisfied within a region of $Ti \geqq 48/14N(\%)+48/32S(\%)$ (N=0.0027%) and Nb=0.008%.

That is, it is found that even at the same amounts of C and Nb, the drawability and the aging resistance are deteriorated as the amount of S increases and consequently the increase in Ti corresponding to the increase in S is required.

On the other hand, with respect to the effect on addition amount of Nb, the increase in Nb is made possible to improve the reduction of AI, i.e. the aging resistance even when the amount of Ti is small and the amount of S is large, but hardly exhibits the improving effect on $\bar{r}$-value.

C: The amount of C is advantageous as low as possible for improving the total elongation (El) and Lankford value ($\bar{r}$-value) which are most important for formable steel sheet, and is preferably $C \leqq 0.0035\%$, more preferably $C \leqq 0.0030\%$. As the C amount increases, large amounts of Ti and Nb are required in order to fix C as a carbide. Consequently, not only the formability is deteriorated due to the precipitation hardening of the resulting precipitates such as TiC, NbC and so on, but also there appears harmful influences such as the rising of the recrystallization temperature in continuous annealing, and the like.

Si: Si may be added for increasing the strength of high strength, deep drawable steel sheets. When the Si amount is added in excess, however, the resistance to second brittleness and the phosphate treating property are unfavorably deteriorated. Therefore, the upper limit of Si is restricted to 1.0%.

Mn: Mn is also restricted to 1.0% by the same reason as the case of Si.

N: N alone is not harmful since it is fixed with Ti prior to the hot rolling likewise the case of S. However, TiN formed by excess addition of N deteriorates the total elongation and the $\bar{r}$-value, so that the upper limit of N is restricted to 0.0035%, preferably not more than 0.0030%.

Further, when the Ti amount is so small that N can not be fixed thereto, N is fixed as AlN. In this case, when the coiling temperature of the hot rolled steel sheet is not more than 710° C., the enlargement of AlN is not proceeded, and as a result a hard product is obtained after the continuous annealing, resulting in the deterioration of the press formability.

S: S is a most important element according to the invention in relation to the Ti amount. S is made harmless as TiS during the heating of slab prior to hot rolling. As seen from the results of FIGS. 1 and 2, however, excess amount of S results in the increase of Ti amount required for the fixation of S as TiS, which causes the degradation of the properties. Therefore, the upper limit of S is restricted to 0.015%.

Ti: Ti is a most important element according to the invention. Ti fixes S and N prior to Al and Nb before the hot rolling. As previously mentioned in detail in FIGS. 1 and 2, the lower limit of Ti is determined by the amount required for fixing S and N, i.e. the following equation:

$$Ti \geqq (48/14N(\%)+48/32S(\%)).$$

Further, when the C amount is relatively higher than the S amount in atomic %, concretely when the Ti, C, N and S amounts satisfy the following inequalities:

$$Ti \geqq 48/14N(\%)+48/32S(\%)$$

and $$TI < 4(C(\%)+N(\%)),$$

the deep drawability is maintained at the sufficient level, while a little deterioration of the ductility can not be avoided but is not departed from the scope of the first invention. In such a case, if a somewhat large amount of Ti, i.e. Ti amount satisfying the following inequality:

$$Ti \geqq 4\cdot(C(\%)+N(\%))$$

is added, the ductility is more improved, at which the second invention aims. This is considered due to the fact that the larger the C amount, the smaller the size of the resulting TiC and the ductility is somewhat deteriorated, but in this case, when Ti is added in an amount of not less than 4(C+N), the enlargement of TiC is proceeded to improve the ductility.

In consideration of the fact that a part of the effective Ti amount (=total Ti−Ti as TiN−Ti as TiS) forms TiC, the upper limit of Ti should be restricted to such an extent that the precipitated TiC and the remaining solute Ti do not cause the degradation of properties, the cost-up of alloy and the decrease of productivity, i.e. the decrease of productivity due to the rising of recrystallization temperature. In consideration of these situations, the upper limit of Ti is restricted to $Ti=(3\cdot 48/12C(\%)+48/14N(\%)+48/32S(\%))$.

Nb: Nb is an important element for fixing C when the Ti amount is low, and is required to be $Nb=(0.2\cdot 93/12C(\%))$ at minimum in relation to C. In this lowest Nb amount, it is considered that Nb is able to fix only 20% of the solute C when C can not be fixed with Ti. However, it has experientially been confirmed that most of the remaining 80% of solute C also forms a particular preprecipitation stage around the precipitated NbC, which does not adversely affect the aging resistance and the ductility.

By adding Nb together with Ti are reduced anisotropies of $\bar{r}$-value and El which are drawbacks in the addition of only Ti. For example, in the Ti-only containing steel having an average $\bar{r}$-value of about 1.7, r-values in the rolling direction ($r_0$) and in a direction perpendicular to the rolling direction ($r_{90}$) are about 2.1 and r-value in a diagonal direction ($r_{45}$) is about 1.3, so that the anisotropy $$\left(\Delta r = \frac{r_0 + r_{90} - 2r_{45}}{2}\right)$$

is 0.8.

On the contrary, in Ti and Nb-containing steel according to the invention, $\Delta r$ becomes about 0.2–0.4 and the anisotropy becomes considerably small, which considerably reduces the occurrence of cracks during the pressing. However, excess addition of Nb not only causes the degradation of properties at low temperature coiling in the hot rolling as shown in FIGS. 1 and 2, but also results in the considerable rising of recrystallization temperature and the cost-up, so that the upper limit of Nb is restricted to the amount equal to C, i.e. to (93/12C(%)).

Al: Al is required in an amount of at least 0.005% for fixing O in molten steel and improving yields of Ti and Nb. On the other hand, most of N in steel is fixed with Ti as mentioned above, so that excess addition of Al results in the cost-up. Therefore, the upper limit of Al is restricted to 0.10%.

P: P is a most effective element for increasing the strength without the decrease of $\bar{r}$-value. However, excess addition of P is unfavorable for the resistance to secondary brittleness. Therefore, the upper limit of P is restricted to 0.15%.

Next, as to the hot rolling conditions, slab-heating temperature prior to the hot rolling is not particularly restricted, but it is not more than 1,280° C. for fixing S and N with Ti, preferably not more than 1,230° C., more preferably not more than 1,150° C.

Incidentally, the same effect can be expected even when the slab is subjected to a so-called direct rolling or a sheet bar of about 30 mm in thickness obtained by casting is subjected to hot rolling as such.

The final temperature in the hot rolling is preferably not less than $Ar_3$ point. However, even if it is lowered up to about 700° C. at $\alpha$ region, the degradation of properties is small.

By the way, the grain size of ferrite ($\alpha$) in the hot rolled steel sheet largely varies in accordance with the change of cooling pattern from the completion of the final rolling to the coiling. In general, when the cooling rate from the completion of final rolling to strip coiling is late, $\alpha$-grains become coarse. In the Ti, Nb composite-added steel according to the invention, this tendency becomes especially remarkable. As $\alpha$-grains become coarser, not only the intergranular area is reduced so as not to develop (111) structure after annealing and $\bar{r}$-value is degraded, but also the grain size of crystals after the annealing becomes larger and the resistance to secondary brittleness is deteriorated. Therefore, it is required that after the completion of final rolling, the rapid cooling such as cooling with water spray is begun as soon as possible, concretely within 2 seconds after the completion of final rolling and the average cooling rate from the beginning of cooling to the coiling is not less than 10° C./sec.

Even when the coiling temperature is not higher than 600° C., good properties can be obtained. When the high-temperature coiling is carried out above 600° C., however, the properties are more improved.

When the coiling temperature exceeds 710° C., not only the effect on the improvement of properties is saturated, but also the descaling property is considerably deteriorated. Therefore, the upper limit is restricted to 710° C.

Next, as to the cold-rolling conditions, in order to improve the drawability, it is required that the draft in the cold-rolling after the descaling is not less than 50%, preferably 70%–90%. Further, as continuous annealing conditions, the Ti and Nb amounts are restricted in accordance with the C, N and S amounts as previously mentioned, whereby steel sheets having a considerably good deep drawability and good aging resistance and anisotropy can be produced. However, only the restriction of these elements insufficiently improves the resistance to secondary brittleness.

Especially, formable steel sheets aiming at the invention are frequently used in strongly forming portions such as high roof for automobile, oil pan of engine and the like, so that it is essential to improve the resistance to secondary brittleness. When the resistance to secondary brittleness is poor, the steel sheet is brittlely broke by strong shock after the press forming, which is unfavorable in view of vehicle body safety.

The addition of B (boron), Sb (antimony) or the like is considered as a method of improving the resistance to secondary brittleness. However, there are such problems that the recrystallization temperature rises in case of the former case and the cost increases in case of the both cases.

According to the invention, these problems are solved by combining the cooling control in the hot rolling as previously mentioned with the heating control in the continuous annealing as mentioned later.

Concretely, the heating rate from 400° to 600° C. during the heating is restricted to not less than 5° C./sec.

Such a restriction is required due to the fact that since the solute P in steel is considerably apt to cause intergranular segregation in such a temperature region, a rapid heating is performed to prevent the intergranular segregation of P, whereby the intergranular strength is enhanced to improve the resistance to secondary brittleness. In the temperature region of 600°–400° C. during the cooling, the resistance to secondary brittleness is good without the particular restriction as in heating. However, if the quenching is performed at a cooling rate of not less than 10° C./sec in such a temperature region, the resistance to secondary brittleness is more improved.

In order to ensure the deep drawability in the continuous annealing, it is required that the soaking is carried out at not less than 700° C. over one second. On the other hand, when the heating temperature exceeds $Ac_3$ point (about 920°–930° C.), the deep drawability is suddenly deteriorated, so that the heating temperature is restricted to 700° C.-$Ac_3$ point.

The following examples are given in the illustration of the invention and are not intended as limitations thereof.

EXAMPLE 1

A steel having a chemical composition of C: 0.0024%, Si: 0.01%, Mn: 0.17%, P: 0.011%, S: 0.005%, Al: 0.037%, N: 0.0021%, Ti: 0.022% ($48/14N(\%)+48/32S(\%)=0.0147\%<Ti<3.48/12C(\%)+48/14N(\%)+48/32S(\%)=0.0435\%$), NB: 0.011% ($0.2.93/12C(\%)=0.0372\%<Nb<1.0.93/12C(\%)=0.0186\%$), and the other inevitable impurities was tapped out from a converter, subjected to an RH degassing treatment, and continuously cast into a slab. Then, the resulting slab was reheated to 1,160° C. and finally hot rolled at 900° C. One second thereafter, the hot rolled steel sheet was rapid cooled on a hot runout table at a rate of 35° C./sec and then coiled at 530° C. The thus obtained sheet was subjected to a pickling and then cold rolled at a draft of 80%.

Then, the heating rate from 400° to 600° C. in the continuous annealing was varied as shown in the following Table 1. In this case, the cold-rolled steel sheet was heated to 400° C. at a heating rate of 15° C./sec and to 600°–795° C. at a rate of 4° C./sec, and subjected to a soaking at 795° C. for 40 seconds, after which the thus heated sheet was cooled from 795° C. to 600° C. at a cooling rate of 1.5° C./sec and in a region of not more than 600° C. at rate of 5° C./sec. The results obtained after 0.5% skin-pass rolling are shown in Table 1. As seen from Table 1, the resistance to secondary brittleness is improved without deteriorating the $\bar{r}$-value and the ductility by restricting the heating rate according to the invention.

TABLE 1

| No. | Heating rate from 400° C. to 600° C. (°C./sec) | YS(1) (kg/mm²) | TS(1) (kg/mm²) | El(1) (%) | $\bar{r}$(2) | Δr(3) | Al(4) (kg/mm²) | Occurrence of brittle cracks(5) |
|---|---|---|---|---|---|---|---|---|
| 1* | 2 | 16.2 | 30.8 | 48.2 | 1.95 | 0.33 | 0.3 | x |
| 2* | 3 | 15.8 | 30.7 | 48.5 | 2.01 | 0.38 | 0.1 | x |
| 3* | 4 | 16.5 | 30.7 | 49.1 | 1.93 | 0.30 | 0.0 | x |
| 4 | 5 | 16.2 | 31.0 | 48.5 | 1.86 | 0.29 | 0.1 | |
| 5 | 6 | 15.7 | 30.5 | 49.5 | 1.96 | 0.34 | 0.0 | |
| 6 | 12 | 15.5 | 30.4 | 49.9 | 2.02 | 0.32 | 0.2 | |

*Comparative Example

Note: (1)Direction of measurement: Rolling direction (2)$\bar{r} = (r_0 + r_{90} + 2r_{45})/4$ (3)$\Delta r = (r_0 + r_{90} - 2r_{45})/2$ Suffixes show angles with respect to the rolling direction, respectively (4)When test sample was subjected to a strain aging at 100° C. for 30 minutes after the application of 7.5% strain, the stress increasing amount was shown as AI (5)The test sample was punched out in 60Ø and then the punched sample was cylindrically drawn at a drawing ratio of 2.00 to form a cup. The resulting cup was subjected to a drop weight tear test at −20° C. under condition of 5 kg × 1 m to examine whether cracks were produced or not.

Symbol " " shows no crack,

"x" shows occurrence of cracks.

EXAMPLE 2

Test steel sheets A–N each having a chemical composition as shown in the following Table 2 were produced under hot rolling conditions as shown in Table 2. In this case, production conditions other than continuous annealing condition were the same as in Example 1.

As to the continuous annealing conditions, the steel sheet was heated to 400° C. at a rate of 13° C./sec, from 400° C. to 650° C. at a rate of 6° C./sec and from 650° C. to 810° C. at a rate of 3° C./sec, and soaked at 810° C. for 20 seconds, and thereafter cooled to room temperature at a rate of 10° C./sec.

TABLE 2

| No. | Chemical composition (% by weight) C | Si | MN | P | S | Al | N | $\frac{48}{14}N + \frac{48}{32}S$ | Ti | $3 \times \frac{48}{12}C + \frac{48}{14}N + \frac{48}{32}S$ | 4(C + N) | $0.2 \times \frac{93}{12}C$ | Nb | $\frac{93}{12}C$ | Coiling temperature (°C.) |
|---|---|---|---|---|---|---|---|---|---|---|---|---|---|---|---|
| A | 0.0016 | 0.02 | 0.15 | 0.010 | 0.004 | 0.041 | 0.0028 | 0.0156 | 0.031 | 0.0348 | 0.0176 | 0.0024 | 0.005 | 0.0124 | 550 |
| B* | 0.0041 | 0.01 | 0.10 | 0.007 | 0.006 | 0.038 | 0.0021 | 0.0162 | 0.022 | 0.0654 | 0.0248 | 0.0063 | 0.013 | 0.0317 | 540 |
| C* | 0.0061 | 0.01 | 0.09 | 0.011 | 0.004 | 0.045 | 0.0023 | 0.0138 | 0.025 | 0.0870 | 0.0336 | 0.0094 | 0.011 | 0.0472 | 530 |
| D* | 0.0026 | 0.01 | 0.15 | 0.009 | 0.005 | 0.051 | 0.0078 | 0.0342 | 0.035 | 0.0654 | 0.0416 | 0.0040 | 0.009 | 0.0201 | 540 |
| E* | 0.0031 | 0.02 | 0.13 | 0.010 | 0.021 | 0.029 | 0.0019 | 0.0380 | 0.065 | 0.0752 | 0.0200 | 0.0048 | 0.010 | 0.0240 | 535 |
| F* | 0.0027 | 0.01 | 0.14 | 0.010 | 0.006 | 0.029 | 0.0025 | 0.0175 | 0.013 | 0.0499 | 0.0208 | 0.0041 | 0.011 | 0.0209 | 540 |
| G* | 0.0025 | TR | 0.12 | 0.009 | 0.004 | 0.030 | 0.0023 | 0.0138 | 0.051 | 0.0438 | 0.0192 | 0.0038 | 0.008 | 0.0193 | 550 |
| H* | 0.0027 | 0.01 | 0.11 | 0.011 | 0.005 | 0.051 | 0.0024 | 0.0157 | 0.028 | 0.0481 | 0.0204 | 0.0041 | 0.003 | 0.0209 | 530 |
| I* | 0.0018 | 0.01 | 0.14 | 0.009 | 0.005 | 0.027 | 0.0018 | 0.0136 | 0.027 | 0.0352 | 0.0144 | 0.0027 | 0.019 | 0.0139 | 550 |
| J | 0.0022 | 0.02 | 0.11 | 0.010 | 0.004 | 0.031 | 0.0030 | 0.0163 | 0.018 | 0.0427 | 0.0208 | 0.0034 | 0.009 | 0.0171 | 545 |
| K | 0.0021 | 0.02 | 0.13 | 0.009 | 0.005 | 0.029 | 0.0021 | 0.0147 | 0.024 | 0.0399 | 0.0168 | 0.0032 | 0.009 | 0.0162 | 685 |
| L | 0.0035 | 0.01 | 0.13 | 0.011 | 0.012 | 0.038 | 0.0024 | 0.0262 | 0.039 | 0.0682 | 0.0236 | 0.0054 | 0.008 | 0.0271 | 680 |
| M | 0.0026 | 0.01 | 0.20 | 0.079 | 0.007 | 0.041 | 0.0029 | 0.0204 | 0.025 | 0.0516 | 0.0220 | 0.0040 | 0.007 | 0.0201 | 530 |
| N | 0.0018 | 0.40 | 0.95 | 0.065 | 0.005 | 0.051 | 0.0031 | 0.0181 | 0.034 | 0.0397 | 0.0196 | 0.0027 | 0.006 | 0.0139 | 530 |
| O* | 0.0040 | 0.01 | 0.10 | 0.007 | 0.006 | 0.035 | 0.0022 | 0.0165 | 0.026 | 0.0645 | 0.0248 | 0.0062 | 0.011 | 0.0310 | 540 |
| P | 0.0025 | 0.01 | 0.13 | 0.008 | 0.004 | 0.044 | 0.0033 | 0.0173 | 0.027 | 0.0473 | 0.0232 | 0.038 | 0.009 | 0.0193 | 550 |

* Comparative Example: The underlined portion is outside the range defined in the invention.

The continuous annealing was carried out at the heatcycle as shown in Table 1, and the soaking conditions and so on were the same as in Example 1. The mechanical properties of the resulting products after 0.5% skinpass rolling are shown in the following Table 3.

TABLE 3

| No. | YS (kg/mm²) | TS (kg/mm²) | El (%) | $\bar{r}$ | Δr | AI (kg/mm²) | Occurrence of brittle cracks |
|---|---|---|---|---|---|---|---|
| A | 14.5 | 28.9 | 52.3 | 2.25 | 0.41 | 0.0 | 0 |
| B* | 16.8 | 31.3 | 45.9 | 1.75 | 0.22 | 1.2 | 0 |
| C* | 24.2 | 34.3 | 42.5 | 1.38 | 0.48 | 4.5 | 0 |
| D* | 25.7 | 34.1 | 41.8 | 1.29 | 0.29 | 1.4 | 0 |
| E* | 15.8 | 30.8 | 48.5 | 1.89 | 0.35 | 0.0 | x |
| F* | 18.8 | 31.2 | 44.8 | 1.45 | 0.31 | 3.8 | 0 |
| G* | 16.5 | 30.8 | 48.3 | 1.91 | 0.33 | 0.0 | x |
| H* | 15.9 | 30.9 | 48.5 | 1.78 | 0.95 | 0.3 | 0 |
| I* | 21.2 | 33.5 | 45.1 | 1.38 | 0.11 | 0.0 | 0 |
| J | 16.1 | 30.3 | 49.4 | 2.02 | 0.19 | 0.0 | 0 |
| K | 14.3 | 29.2 | 51.8 | 2.31 | 0.36 | 0.0 | 0 |
| L | 15.1 | 30.0 | 50.0 | 2.01 | 0.39 | 0.5 | 0 |
| M | 20.5 | 37.1 | 44.8 | 1.91 | 0.22 | 0.3 | 0 |
| N | 23.9 | 43.4 | 39.1 | 1.71 | 0.20 | 0.5 | 0 |
| O* | 16.3 | 31.0 | 47.9 | 1.76 | 0.23 | 0.9 | 0 |
| P | 17.0 | 30.5 | 49.2 | 1.96 | 0.31 | 0.0 | 0 |

*Comparative Example
Methods of measurement are the same as in Example 1.

The C amount in Comparative Steels B, C and O, the N and S amounts in Comparative Steels D and E, and the Ti or Nb amount in relation to the C, N and S amounts in Comparative Steels F, G, H and I were outside the ranges defined in the invention, respectively. These comparative steels were poor in the properties. Steels A, I and P and Steels L and M show examples of soft steel sheet and high tensile steel sheet according to the first and second inventions, respectively. In Steel J, the Ti amount is somewhat lower than that in Steel P, but the other conditions are almost the same. Therefore, Steel J represents an example of the first invention.

Accordingly, good properties were obtained in not only the mild steel sheet level (TS≦35 kg/mm²) but also the high tensile steel sheet containing a strengthening element such as P, Mn or the like.

According to the invention, it is possible to produce steel sheets satisfying all conditions required in pressformable steel sheet such as automobile body or the like, whose effect is utmost.

What is claimed is:

1. A method of manufacturing a cold rolled steel sheet having a good deep drawability, which comprises beginning a cooling within 2 seconds after the completion of finisher rolling of a hot rolled sheet of steel having a composition of not more than 0.0035% of C, not more than 1.0% of Si, not more than 1.0% of Mn, 0.005–0.10% of Al, not more than 0.15% of P, not more than 0.0035% of N, not more than 0.015% of S, $(48/14N(\%)+48/32S(\%))\sim(3\cdot48/12C(\%)+48/14N(\%)+48/32S(\%))$ of Ti and $(0.2\cdot93/12C(\%))\sim(93/12C(\%))$ of Nb;

cooling the final rolled steel sheet at an average cooling rate of not less than 10° C./sec until it arrives at a coiling step;

coiling the cooled steel sheet at a temperature of not more than 710° C.;

subjecting the coiled steel sheet to a cold rolling at a reduction of not less than 50%; and subjecting the cold rolled steel sheet to a continuous annealing in a heatcycle inclusive of heating from 400° C. to 600° C. at a heating rate of not less than 5° C./sec and soaking at a temperature range of 700° C.-$Ac_3$ point for not less than one second.

2. A method for manufacturing a cold rolled steel sheet having a good deep drawability, which comprises beginning a cooling within 2 seconds after the completion of finisher rolling of a hot rolled sheet of steel having a composition of not more than 0.0035% of C, not more than 1.0% of Si, not more than 1.0% of Mn, 0.005–0.10% of Al, not more than 0.15% of P, not more than 0.0035% of N, not more than 0.015% of S, $4\cdot(C(\%)+N(\%))\sim(3\cdot48/12C(\%)+48/14N(\%)+48/32S(\%))$ of Ti and $(0.2\cdot93/12C(\%))\sim(93/12C(\%))$ of Nb;

cooling the final rolled steel sheet at an average cooling rate of not less than 10° C./sec until it arrives at a coiling step;

coiling the cooled steel sheet at a temperature of not more than 710° C., subjecting the coiled steel sheet to a cold rolling at a reduction of not less than 50%; and subjecting the cold rolled steel sheet to a continuous annealing in a heatcycle inclusive of heating from 400° C. to 600° C. at a heating rate of not less than 5° C./sec and soaking at a temperature range of 700° C.-$Ac_3$ point for not less than one second.

* * * * *